United States Patent [19]

Ahl

[11] 4,374,634

[45] Feb. 22, 1983

[54] DEVICE FOR LIFTING SLIDING MOLDS ALONG STEEL BARS FOR THE CONSTRUCTION OF CONCRETE BUILDINGS AND THE LIKE

[76] Inventor: Bernhard Ahl, Am Zehnpfennigshof 13, 5000 Köln 50, Fed. Rep. of Germany

[21] Appl. No.: 208,379

[22] Filed: Nov. 19, 1980

[30] Foreign Application Priority Data

Nov. 23, 1979 [DE] Fed. Rep. of Germany ..... 2947210

[51] Int. Cl.[3] ..... E04G 11/22

[52] U.S. Cl. ..... 425/65; 249/20

[58] Field of Search ..... 425/63, 65; 249/20, 249/22

[56] References Cited

U.S. PATENT DOCUMENTS

| | | | |
|---|---|---|---|
| 2,016,575 | 10/1935 | Nemee et al. | 425/63 |
| 3,252,199 | 5/1966 | Bossner | 425/65 |
| 3,521,336 | 7/1970 | Rohlf | 425/63 |
| 3,659,978 | 5/1972 | Svensson et al. | 425/63 |
| 3,663,132 | 5/1972 | Andersson | 425/65 |
| 3,779,678 | 12/1973 | Scheller | 425/65 |
| 3,973,885 | 8/1976 | Schmidt | 425/65 |
| 4,040,774 | 8/1977 | Scheller | 425/65 |

FOREIGN PATENT DOCUMENTS

| | | | |
|---|---|---|---|
| 1434472 | 4/1969 | Fed. Rep. of Germany | 425/63 |
| 1198377 | 7/1970 | United Kingdom | 425/63 |

*Primary Examiner*—James B. Lowe

*Attorney, Agent, or Firm*—John C. Smith, Jr.

[57] ABSTRACT

Apparatus for successively lifting sliding molds during construction of concrete buildings and the like having a variable cross-section of straight or curved walls includes a plurality of yoke structures for supporting the sliding molds, each yoke structure being associated with a hoist means. Each of the yoke structures comprises a lower traverse secured to a hoist means, an upper traverse, spaced inner and outer yoke posts extending between and pivotally secured to the traverses and an adjustable brace extending between the outer yoke post and the upper traverse such that the traverses and inner and outer yoke posts form a parallelogram yoke structure which may be adjusted by the brace. Each of the yoke structures is displaceably secured to a star beam system permitting radial movement of the yoke structures therealong. An annular framework system including work platforms is connected to the yoke structures and adapted to be arranged tangentially at the periphery of the building. The apparatus is adjustable continuously during construction by a central hydraulic control means as the cross-section of the building decreases and the thickness of the walls decreases with increasing height.

13 Claims, 15 Drawing Figures

DEVICE FOR LIFTING SLIDING MOLDS ALONG STEEL BARS FOR THE CONSTRUCTION OF CONCRETE BUILDINGS AND THE LIKE

The invention relates to a device for lifting sliding molds for the construction of straight or curved walls of concrete buildings and the like which walls have variable cross-sections. A frame system and control arrangement is adapted to adjust and guide the sliding molds during construction of the concrete walls.

BACKGROUND OF THE INVENTION

Steel reinforced concrete chimneys, television towers, bridge pillars and the like of substantial height have a variable cross-section for both static and economic reasons, i.e. the diameter or cross-section is tapered, usually the wall thickness decreasing with increasing height. The construction of such buildings may be accomplished by utilizing a sliding structure technique in which a lifting device serves to periodically hoist a supporting scaffolding, including a star beam system for the radial movement of yoke structures carrying sliding molds, a ring-shaped framework system tangentially arranged about the periphery of the building and working platforms connected to the supporting scaffolding.

With respect to buildings having variable cross-sections, the distances between the lifter units for lifting the sliding molds must be changed synchronously with respect to the wall inclination and wall thickness. The prior art devices for accomplishing this can be classified in two groups, those comprising a star beam system in which the radial movement of the yoke structures is guided by means of central symmetrical beams, and the ring-shaped system in which the adjustment of the radial movable yoke structures is performed by an annular framework. The framework is a lattice arrangement repeated in each support unit and tangentially connected along the periphery of the building in a ring-shaped arrangement. The ring-shaped construction may be enlarged or reduced with each lifting step by a mechanical system.

Due to increasing demands, namely, steel reinforced concrete chimneys to 300 meters in height and to 45 meters in diameter, the prior art heavy self-supporting latticed constructions for supporting the star beam system and associated heavy loads have become uneconomical. The supporting scaffolding is subject to cants, the climbing bars may become deformed and the concrete construction itself also suffers from deformation thus resulting in interruptions during the sliding operation. The same difficulties also arise with the framework system. Diagonal tensions on the winding tower, the ropes and the yoke structure increase as the total working platform area, the amount of concrete material and the number of people increases.

In both systems the configuration and arrangement of the yoke structure is an essential element. To date, the yoke structures have been rigid, rectangular frame structures, though in some cases one yoke post may be movable relative to the other. The inclination of the steel concrete walls to be erected has been achieved either by means of rigid, rectangular yoke structures with the steel molds maintained in a sloping position parallel to the wall inclination by means of spindles between the yoke post and the molds or in the ring-shaped system by means of spindles. In both systems, a uniform hoisting and reduction of the shell skin cannot be attained due to the arrangement of the yoke structures and the mold skin which cannot be adjusted synchronously. One side of the molds will always be pressed against the inclined concrete surface during the lifting operation. As a result, there is risk particularly with large diameters and a substantial inclination of the wall that concrete will be lifted with the sliding movement resulting in cracks being formed which may entail dismantling the building.

In the case of greater inclinations, it has been necessary to additionally incline the yoke posts of the support scaffoldings, and the guidance of the yoke posts has been insured by superimposed rolls. When the inclination was greater, jammings occurred because of the key effect, and the sliding movement was adversely affected.

SUMMARY OF THE INVENTION

An object of the invention is to provide a frame system in association with a control unit which even with substantially greater diameter buildings and greater wall inclination insures a perfect sliding with a lightly constructed frame, support scaffolding and yoke structure.

The invention is characterized in that the yoke structure has a traverse below the lifter and secured thereto and a traverse extending above the lifter, inner and outer yoke posts pivotally connected with the traverses, the end of the traverses on the side of the inner yoke post being pivotally connected by the latter and the free end of the upper traverse with the outer yoke post by means of a brace which is adjustable in length, and the adjustable parallelogram-yoke structure formed by the traverses and yoke posts is displaceably supported in total along a star beam.

The frame system or yoke structure design of the present invention permits the yoke posts of the yoke structure, the working platform, and the hanging stage posts to extend parallel to the axis of the wall during erection. As a result of the articulated connections between the yoke posts and traverses and of the additionally articulated inclined spindle guidance between the outer yoke post and the axis of the upper traverse, the lower and upper traverses of the yoke structures as well as the traverses of the working and hanging stages may be basically maintained in a horizontal plane. The inclination of the yoke structures is adjusted while the traverses extend horizontally and in the form of a parallelogram. Any desired inclination can be obtained, with an absolute rigidity of the frame and a simultaneous horizontal position of all stages and platforms due to the parallelogram arrangement, by means of one sole inclined spindle and by an automatic guidance arrangement between the upper traverse and the overlying support. The use of the framework system in conjunction with the star beam system permits an automatic uniform change of the diameters.

The longitudinal displacement of the yoke structure at the star beam is performed advantageously by means of a spindle drive wherein the upper traverse is connected to the star beam by means of slide guides. In addition, the inner yoke post is adjustable along the two traverses by means of a spindle drive. Moreover, the mutual distance of the outer yoke posts and of the inner yoke posts can be adjusted in the peripheral direction by spindle drives, the adjusting devices being lifted at the posts by the height of the molds.

According to another feature of the invention, use is made, preferably, of rack-and-pinion gears in connection with the spindle drives for the longitudinal displacement of the yoke structure, the adjustment of the inner yoke post and the adjustment of the mutual distance of the inner yoke structures. In this case a rack intermeshes with a gear integrally connected with the threaded spindle, and the rack can be adjusted relative to the rack housing by means of a hydraulically operated piston-cylinder unit. For the common control, the hydraulic cylinder for the stated spindle drives and the hydraulic cylinder of the lifter are interconnected hydraulically, and it is possible to actuate the hydraulic cylinders either together or independently of each other by means of control and changeover valves. Thus, it is possible to have a program-controlled hydraulic circuit for the total operation.

With the parallelogram guidance of the yoke structure in connection with an automatic control device for the spindle drives all or several motions required for the sliding may be performed simultaneously. This is applicable to the hoisting of the molds by hydraulic lifters, the displacement of all of the yoke structures, the displacement of the inner yoke post and the change of the inner and outer framework. A perfect positive guidance of the displaceable elements of the frame system can be performed, and an absolutely accurate and homogeneous concrete structure may be built.

For the tapering of the walls, a parallel displacement of the inner yoke post is advantageously provided. The mold skin is suitably flexibly suspended at the inner and outer yoke post and extends in parallel to the axes of the yoke posts. Additional changes of the walls, e.g. for brackets, can be adjusted in the lower region of the mold skin by radially-acting adjusting means at the yoke posts.

Moreover, the invention advantageously provides that the upper working platform be pivotally connected at the yoke posts and, at the side of the outer yoke post, at the upper traverse as well as at the inner yoke post side at the star beam. The lower working platform may have holding bars which are insertably supported in the yoke posts, the holding bars in external position being hinged at the working platform. Due to the pivotal connections, horizontal positioning of the catwalks of the working platforms is insured.

the star beams which may be spaced U-shaped profile members may be divided in sections which may be telescoped with respect to one another and locked at any predetermined length for adjustment purposes.

DETAILED DESCRIPTION OF THE INVENTION

Figure 1:
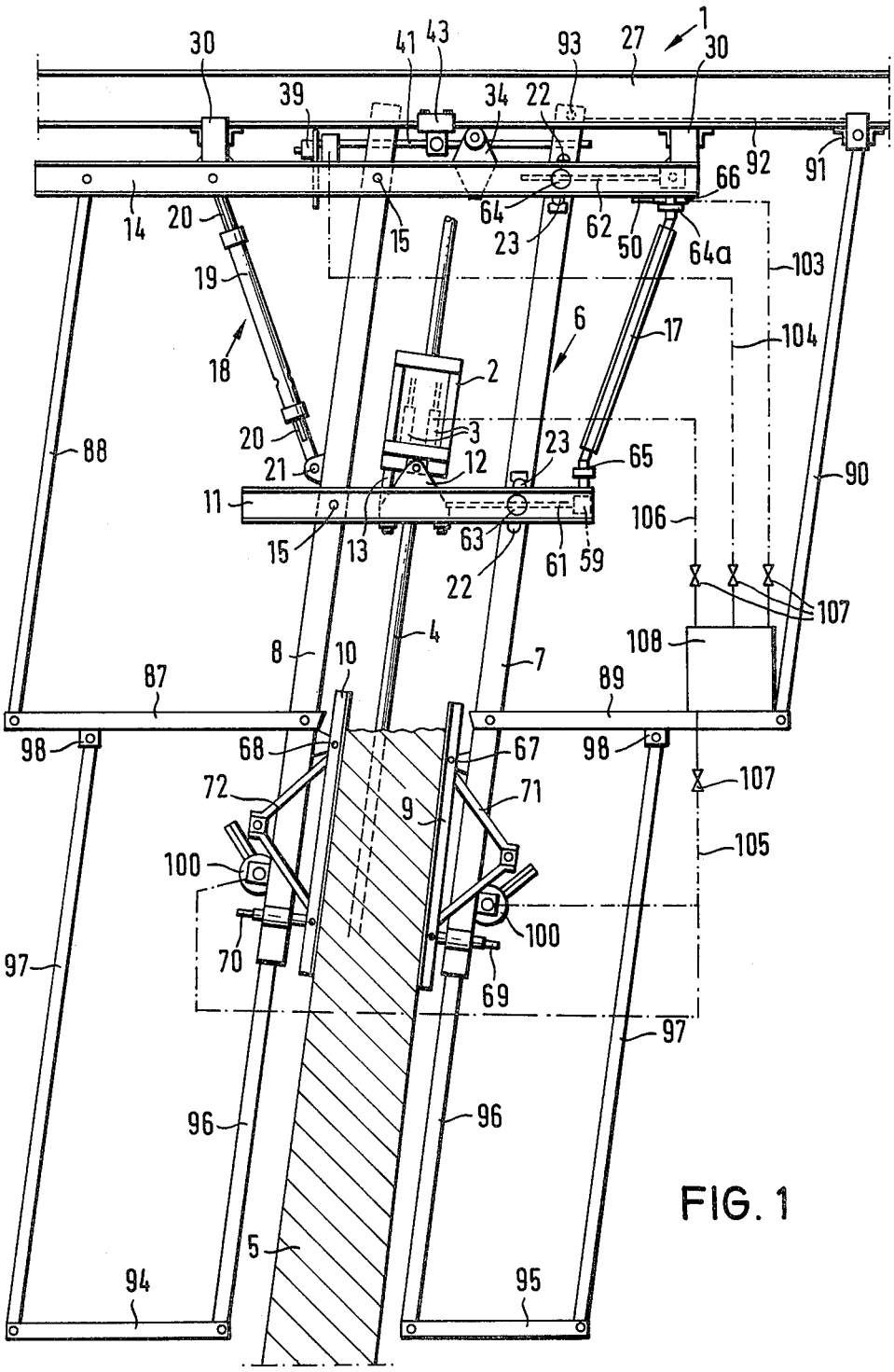
FIG. 1 is a schematic view of an embodiment of the frame system for the yoke structure of the invention.

Referring to FIG. 1, the slide mold construction 1 includes hoists 2 which cooperate by means of hydraulic cylinders 3, eccentric clamping devices, etc. with climbing bars 4. The entire slide mold construction 1 is carried by means of the hoists 2. The climbing bars 4 are arranged in spaced relation in the concrete wall under construction.

The slide mold construction 1 includes a plurality of yoke structures, one of which is illustrated in FIG. 1, each connected to a hoist 2. Each yoke structure 6 comprises an inner yoke post 7 and an outer yoke post 8, the lower ends of which support an internal slide mold 9 and an external slide mold 10, respectively. A lower traverse 11 is connected to the hoist 2 by means of a trestle 12 and an adjusting screw 13, and an upper traverse 14 is located above the hoist 2. The outer yoke post is pivotally connected to traverses 11 and 15 by bolts 15, and the inner yoke post 7 is connected to the traverses 11 and 14 by means of guides. Thus, the yoke posts 7 and 8 and traverses 11 and 14 which are pivotally joined form an adjustable parallelogram. The adjustment is made by a brace 18, preferably designed as an inclined turnbuckle brace having a rotatable central portion 19 and two threaded bolts 20. The upper threaded bolt 20 is pivotally mounted on the upper traverse 14 while the lower threaded bolt 20 at the end of the turnbuckle brace 18 is pivotally connected at 21 with the outer yoke post 8. Thus, the parallelogram-like yoke structure may be easily inclined. It is possible to adapt the yoke posts to the inclination of the climbing bar 4 and to maintain the yoke structure in a predetermined parallelogram position. The guidance of the inner yoke post 7 at the traverses 11 and 14 may be affected by bolts 22 and 23 having semicircular flat ends, the bolts 23 engaging with support elements.

Referring to FIGS. 1–6, the yoke structure 7, 8, 11, 14 is longitudinally adjustably guided at a star beam 27, the star beam comprising two oppositely disposed U-shaped profile members 28 which are maintained at a predetermined mutual distance. Guide trestles 30 are mounted on the upper traverse 14 for carrying the star beam 27, the guide trestles 30 embracing the lower flanges of the U-shaped profile members 28 so that a displacement of the yoke structure towards the star beam 27 can be made in its longitudinal direction. To the lower portion of the guide trestles 30, a square pipe member 31 is secured. The traverse 14 comprising U-shaped bars 32 is attached to the square pipe member 31 by means of angular members 33.

Figure 7:
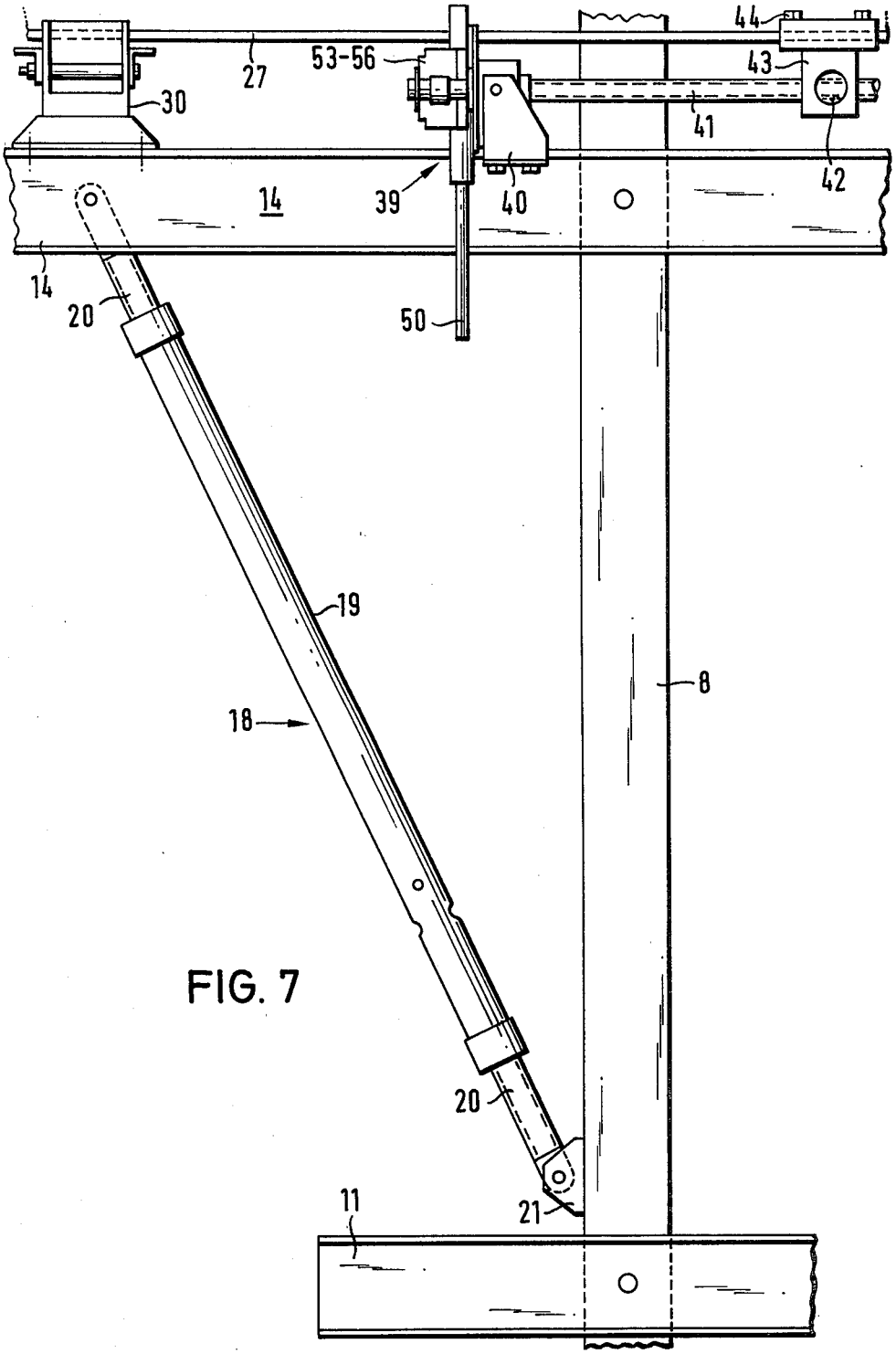
FIG. 7 is an enlarged elevational view of the guidance and adjusting means of the upper traverse of the yoke structure at the star beams.
Figure 8:
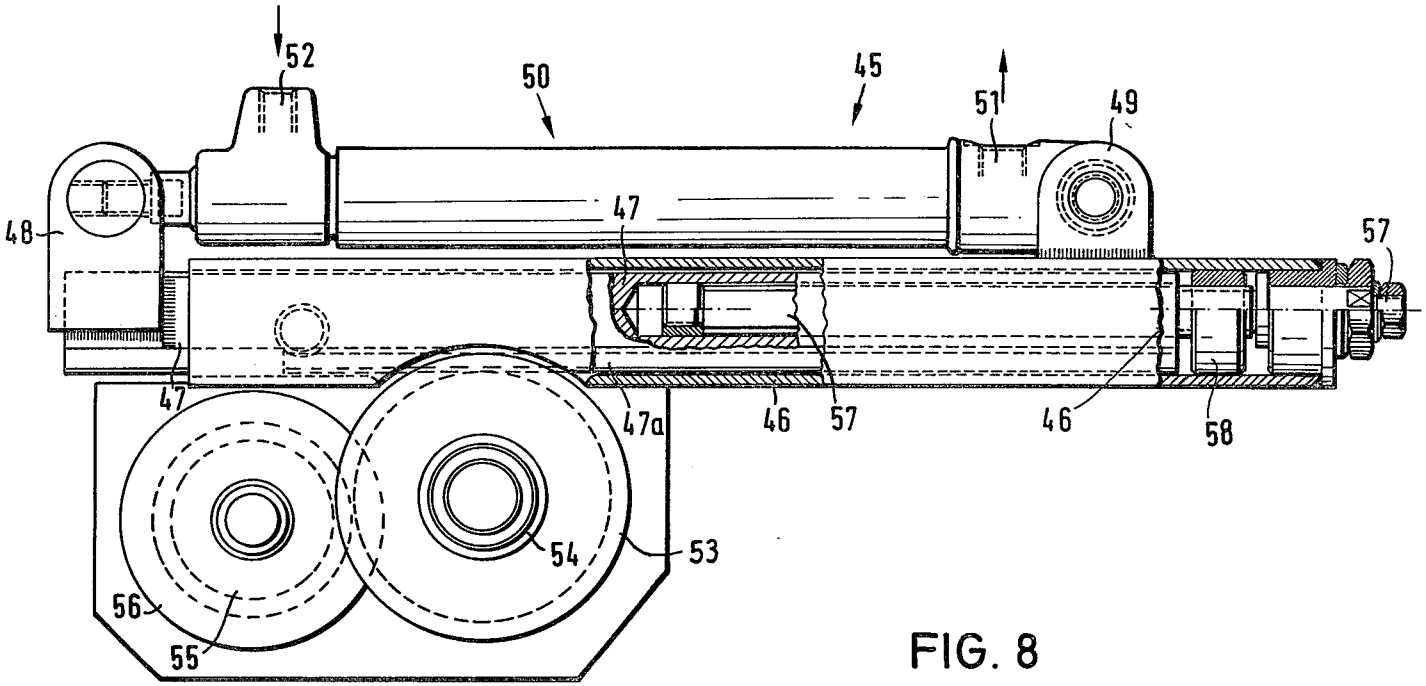
FIG. 8 is a schematic elevational view of an embodiment of the rack-and-pinion gear for adjusting the parallelogram guidance of the yoke structure and at the star beams.

Between the two guide trestles 30 is arranged a rolling fixture 34 secured to the traverse 14 by means of screws 35. The fixture 34 includes crown rolls 36 which rest internally against the U-shaped profile members 28. The numeral 37 identifies a spacer. With this arrangement traverse 14 supports the star beam 27 as a load-bearing member, and it can be easily displaced along the star beam 27. Displacing the traverse 14 with the appertaining yoke structure relative to the star beam 27 is carried out by means of a spindle drive 39 shown in FIG. 7. At the traverse 14 is attached a trestle 40. The spindle drive 39 has a threaded spindle 41 guided by a nut 42 supported in a trestle 43 which is secured to the star beam 27 by means of screws 44. Advantageously, the spindle drive 39 is a rack-and-pinion gear 45. In a sleeve 46 (FIG. 8) a rack 47 is supported such that it may be displaced in length. The portion of the rack 47 protruding from the sleeve 46 has a trestle 48 while the sleeve 46 is firmly connected to a trestle 49. A piston-cylinder unit 50 is located between the trestles 48 and 49, the unit 50 being provided with terminals 51 and 52 for the hydraulic control medium. A gear 53 intermeshes with the teeth 47*a* of the rack. An additional gear 55 may intermesh with gear 54, and its axle may be provided with a locking pawl 56. The threaded spindle 41 is firmly connected with the axle 54 of the gear 53. The gear 47 can be moved longitudinally in the casing 46 by the piston-cylinder unit 50 causing the gear 53 to be rotated together with the threaded spindle 41. The extent of displacement of the rack can be limited by means of a set screw 57 and an abutment 58, the set screw 57 being stationarily supported at the sleeve 46 and projecting into the gear 47. When the rack-and-pinion gear 45 is actuated, the traverse 14 together with the yoke structure is displaced along the threaded sipndle 41. The pawl system 56 has two pawls which may be optionally operative and which may lock the rotation in one direction or the other.

Figure 9:
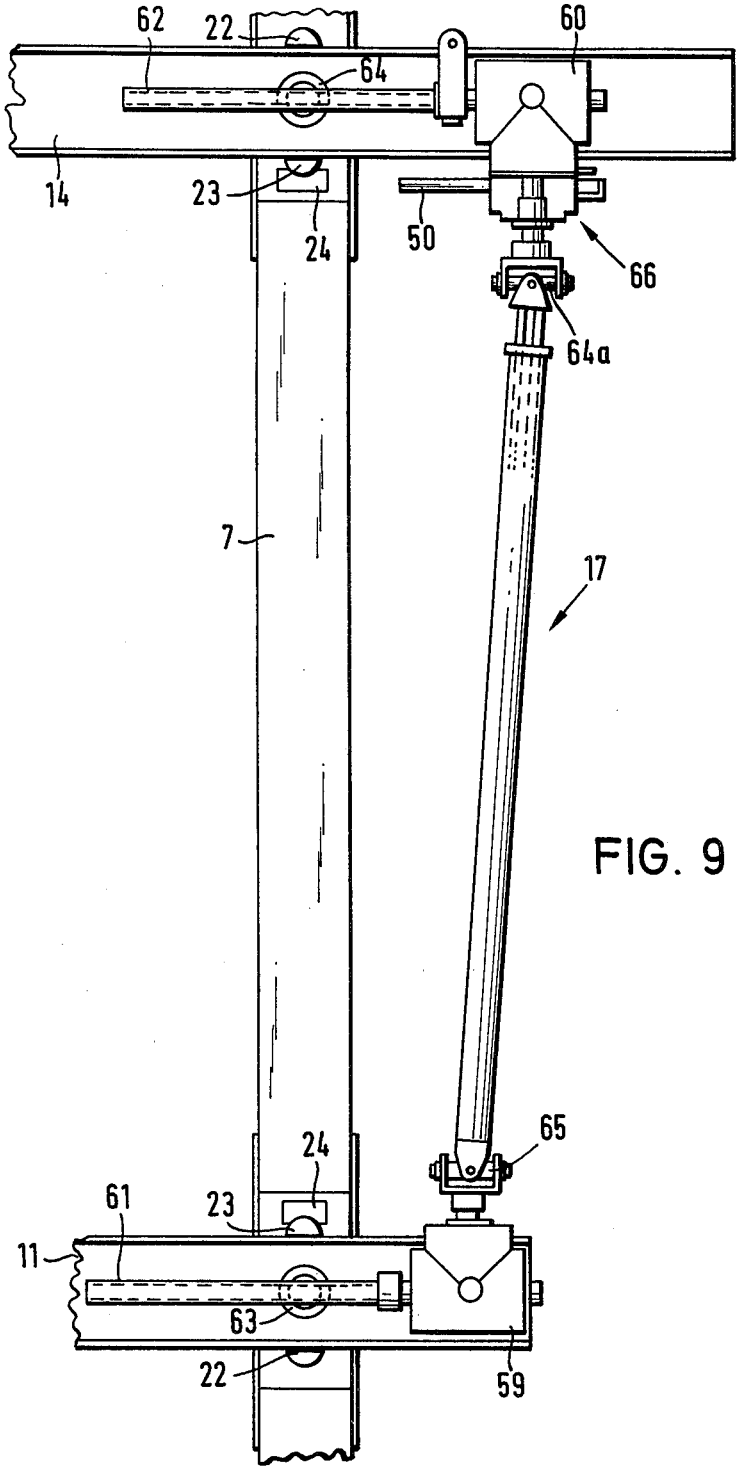
FIG. 9 is an enlarged schematic elevational view of the adjusting means for the inner yoke post and the support of the yoke post at the upper and lower traverses of the yoke structure.

The wall thickness of the concrete wall can be changed by adjusting the position of the inner yoke post 7 relative to the outer yoke post 8 in accordance with the required wall inclination. Connected to the traverses 11 and 14 are guide gears 59 nand 60 (FIG. 9) which comprise threaded spindles 61 and 62 engaging with threaded nuts 63 and 64 disposed in the traverses 11 and 14, respectively. The guide gear 60 is fitted with a sindle gear 66 which can be driven hydraulically and the construction of which corresponds to the hydraulically operated rack-and-pinion gear 45 (FIG. 8) with the pawl system. Between a telescopic connection brace 17 and the adjacent gears are universal joints 64*a* and 65. The thickness of the building wall can be changed in a predetermined manner when the wall is erected by means of the spindle gear 66.

Figure 12:
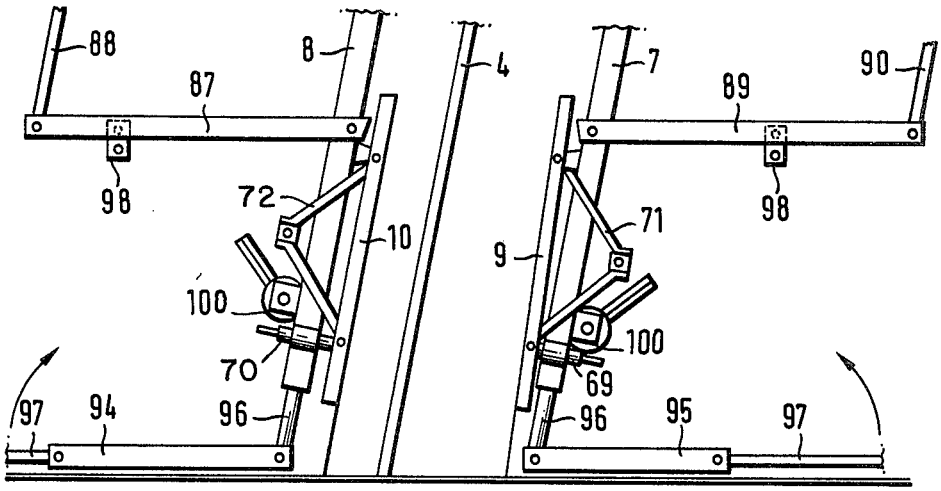
FIG. 12 is a schematic elevational view of the lower portion of the yoke structure associated with the slide molds, of the arrangement of the working platform and of the hanging stage at the yoke posts.
Figure 10:
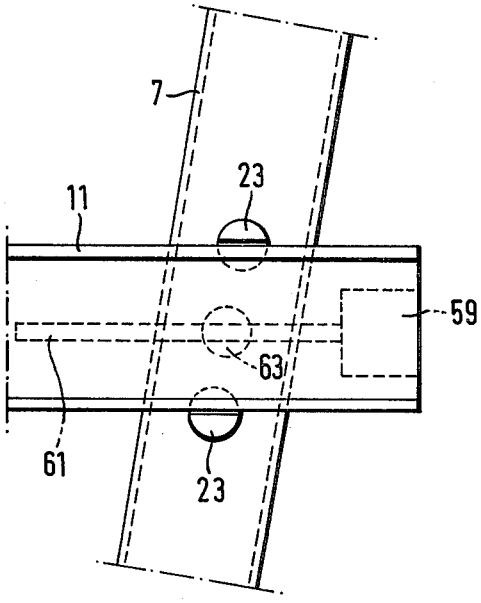
FIG. 10 is an enlarged schematic elevational view of the support of the inner yoke post at the traverses of the yoke structure.
Figure 11:
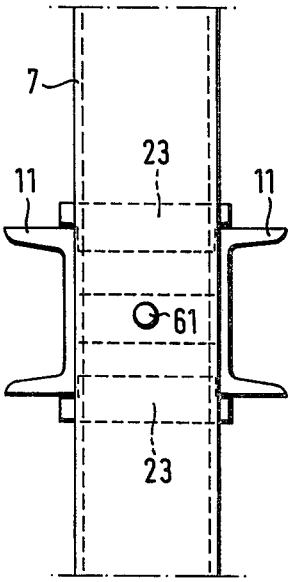
FIG. 11 is a side view of the support illustrated in FIG. 10.

The internal and external slide molds 9 and 10 are pivotally supported on the inner and outer yoke posts 7 and 8 at 67 and 68. The inclination of the molds 9 and 10 can be adjusted at their lower ends by manual adjusting means 69 and 70 (FIG. 12). Rigid elements 71 and 72 are secured to the rear sides of the molds, respectively.

Figure 13:
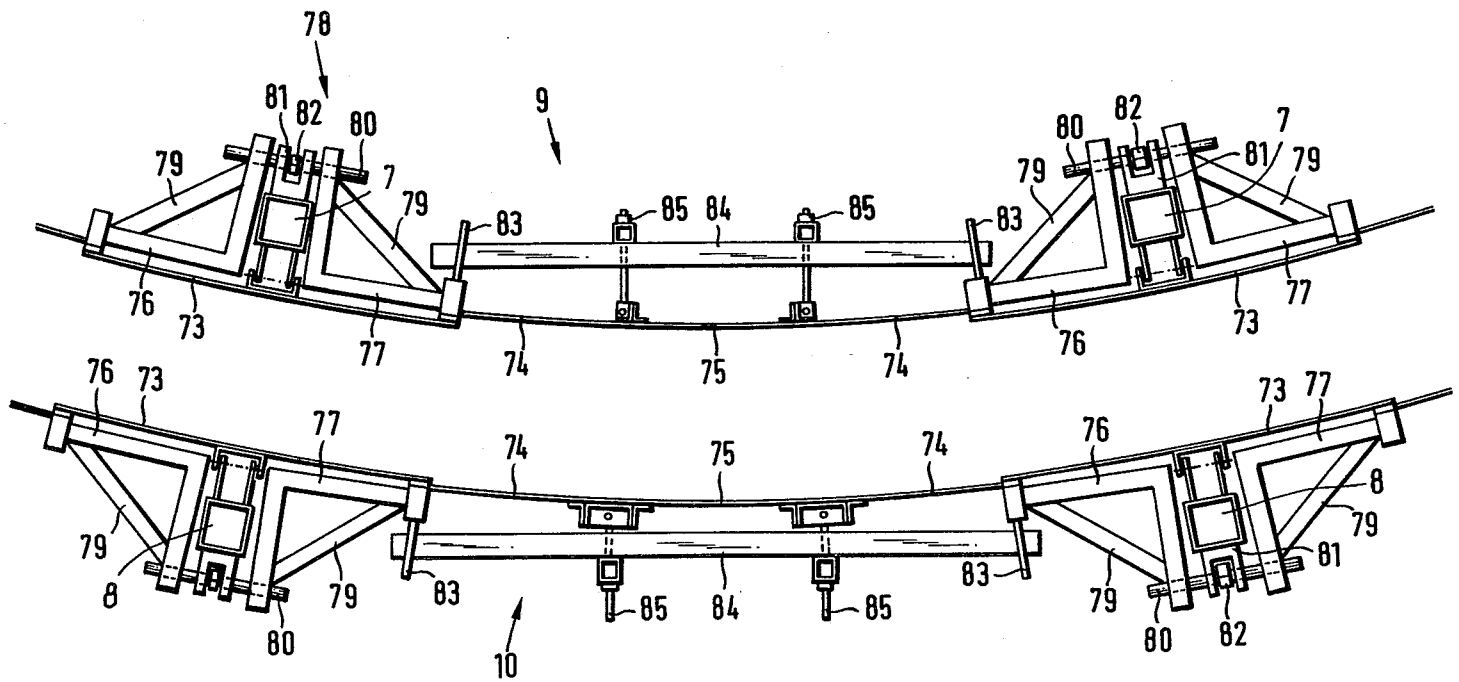
FIG. 13 is a schematic plan view of the mold arrangement illustrating guidance and adjustment of the intermediate plates.

The mold skin (FIG. 13) comprises main plates 73, shifting plates 74 and an additional plate 75. To shape the main plates 73 an adjusting mechanism 78 is provided which comprises angular elements 76, 77 reinforced by diagonal braces 79. To adjust the angular elements, a spindle 80 is provided which is supported in a trestle 81 connected to the yoke post 7 or 8 and which can be actuated by means of a nut 82. The intermediate plates 74 and 75 are guided by mountings 83 supporting a stiffening tube 84 and may be adapted to the desired curvature or circular shape by means of spindles 85. The intermediate plates 74 and 75 are aligned and may be supplemented or removed upon demand.

The working platform 87 (FIGS. 1 and 12) at the outer yoke post 8 is flexibly suspended by means of a bar or tube 88 at the following traverse 14 while the working platform at the inner yoke post 7 is suspended flexibly by means of a bar 90 connected to a carriage 91 slideingly mounted on the star beam 27. The carriage 91 is connected to the upper end of the inner yoke post 7 at 93 by means of a distance tube 92. The lower working platforms 94 and 95 serve as a hanging stage having holding bars or tubes 96, 97 which may be connected flexibly with the working platforms 87 and 88 and holding bars 96 which can be inserted into the yoke posts 7 and 8. During the assembly of the slide mold construction, the holding tubes 96 are already inserted in the yoke posts 7 and 8 while the holding bars 97 are first folded down horizontally. With the further lifting of the slide mold construction, the holding tubes 96 inserted into the yoke posts are withdrawn to their end positions and the horizontally placed holding bar 97 is suspended pivotally from holders 98. As a result the lower working platforms 94 and 95, like the working platforms 87 and 89, are arranged to be adapted to changes in the inclined position of the yoke posts 7, 8.

Figure 2:
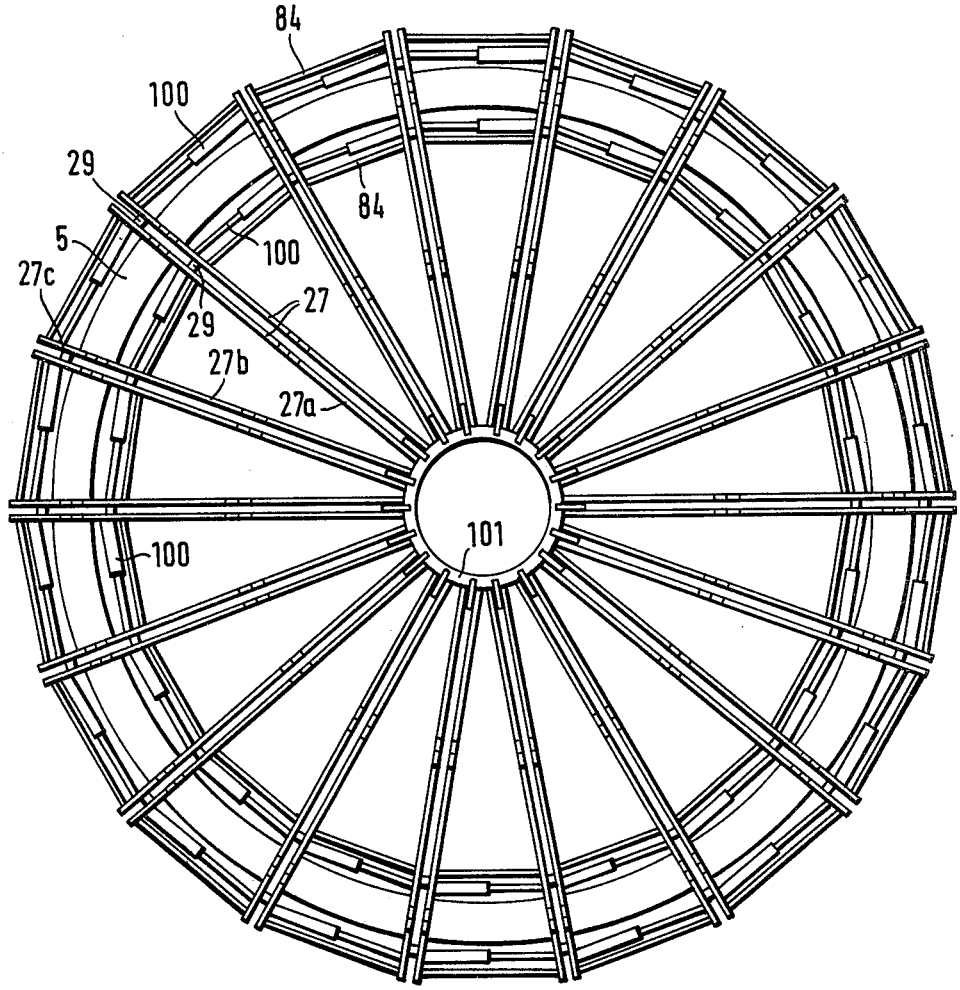
FIGS. 2 and 3 are schematic plan views of the frame system with yoke structures, the star beam system and the framework system, FIG. 2 illustrating the frame system at the beginning of building construction and FIG. 3 illustrating the frame system at the termination of construction.
Figure 3:
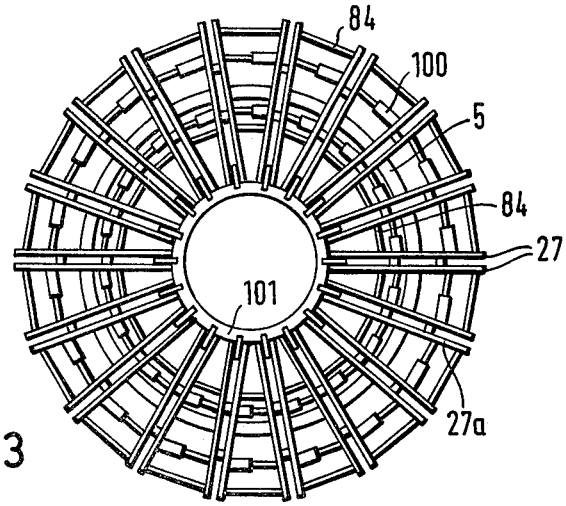
Figure 4:
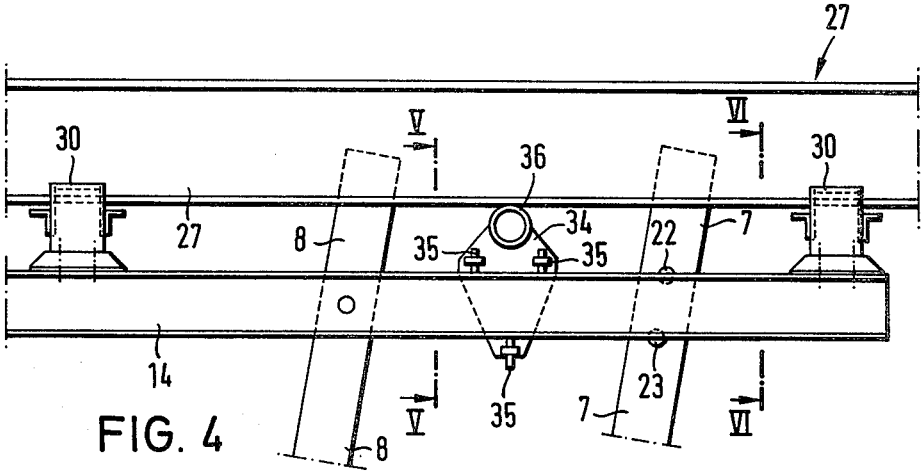
FIG. 4 is an enlarged schematic sectional view of the support for the star beams on the upper traverse of the yoke structure.
Figure 5:
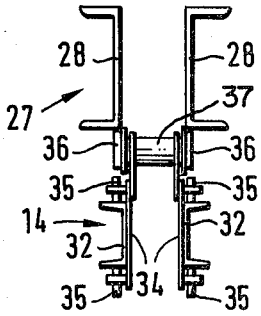
FIGS. 5 and 6 are cross-sectional views taken along the lines V—V and VI—VI, respectively, of FIG. 4.
Figure 6:
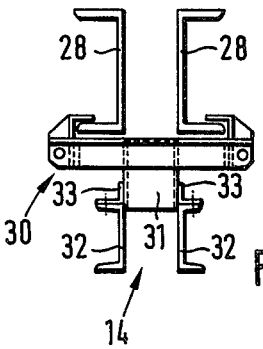

The star beams 27, which are carried via the traverses 11, 14 and the yoke posts 7, 8, are held at a predetermined mutual distance at opposite sides of the concrete wall by means of spindle drives 100 extending between the lower portions of adjacent inner yoke posts 7 and adjacent outer yoke posts 8 (FIGS. 1 and 2). The spindle drives 100 are advantageously of the same design as previously described spindle drives, i.e. rack-and-pinion gears 45 with adapted locking pawl 56. The inner ends of the star beams 27 are mounted as an internal ring 101 of the framework. The change of the periphery of the frame system is performed by the hydraulically controlled rack-and-pinion gear which serves to adjust a spindle with the displaceable rack.

The hydraulic cylinder of the spindle drive 39 is operative to longitudinally adjust the yoke structure at the star beams 27, 66 for the parallel displacement of the inner yoke post 7 with respect to the tapering of the wall to adjust the distance of the yoke structures with respect to each other with the change of dimension of the periphery of the building. The piston-cylinder units 3 of the hoist 2 can be interconnected by hydraulic lines 103, 104, 105 and 106 via control and changeover valves 107 with the use of a central switch device 108. This system permits fully automatic control in a single operation with each lifting of the slide mold construction, the change of the building diameter by changing the wall inclinations by means of inclined brace 18 and the change of the wall thickness. Adjustment of the rack-and-pinion gear associated with the locking pawl permits the desired dimensions to be readily set for all of the changes. The pre-programmed values may be precisely realized by means of the switch system so that the erection of the building can be performed safely, quickly and reliably. The inclination of the wall under erection can be accurately determined and adjusted by the parallelogram construction of the yoke structure and the two traverses.

Figure 14:
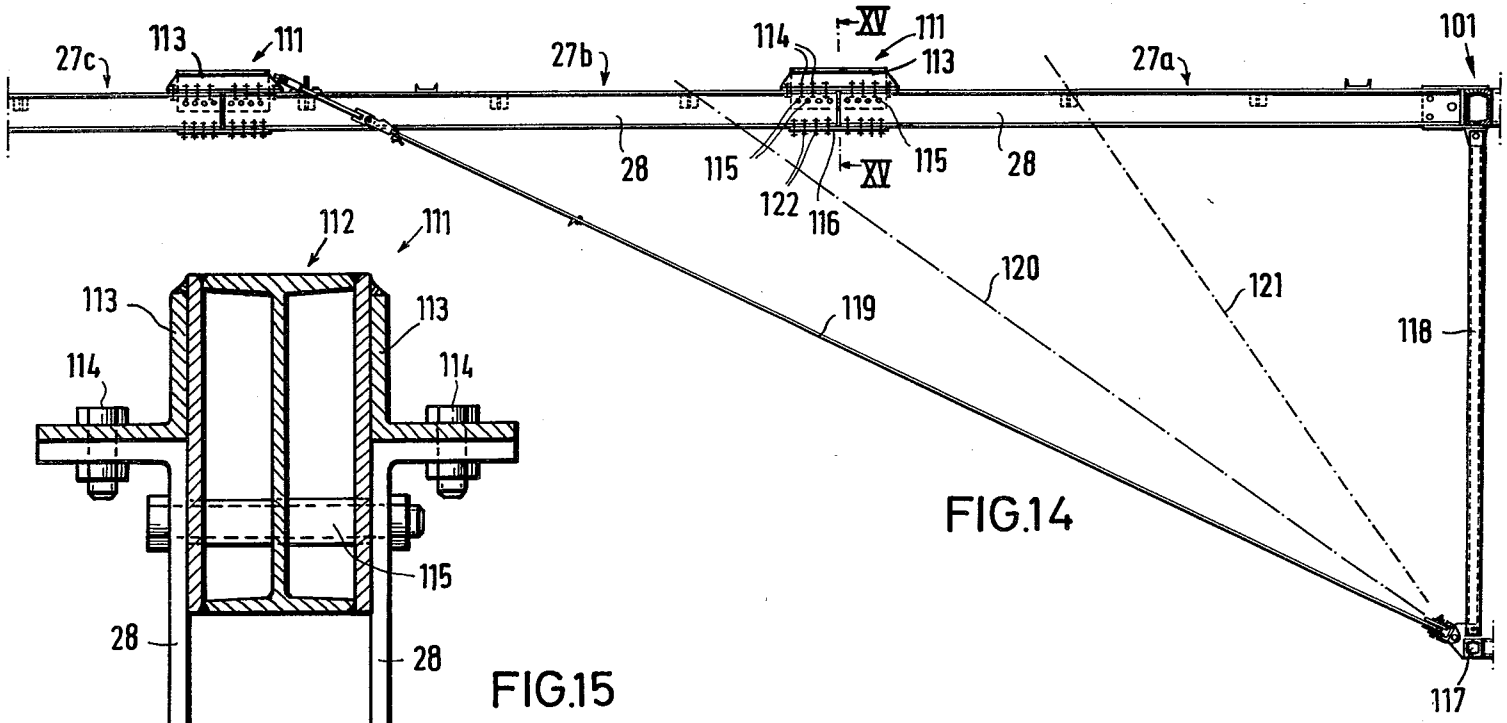
FIG. 14 is a schematic view of the subdivided star beam with star beam portions detachable from each other.
Figure 15:
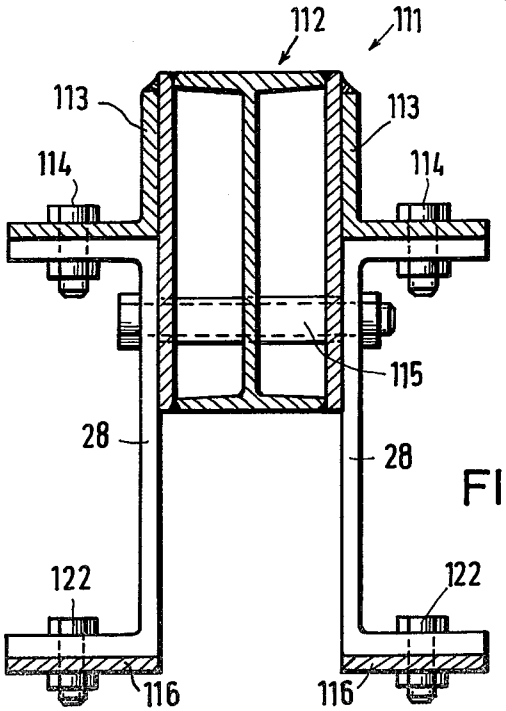
FIG. 15 is a sectional view taken along the line XV—XV of FIG. 14

The star beams 27 are preferably divided lengthwise (FIG. 14). For example, they may be composed of sections *27a, 27b* and *27c*. The sections are connected by flap bodies 111 which are mounted on the upper girders of the U-shaped profile members 28. Each flap body 111 may be composed of a core element 112 and a laterally arranged angular member 113. The elements 112 and 113 are integrally connected, e.g. by welding. The core element 112 partly engages the interspace between the two U-shaped profile members 28, the core element being shaped like a housing or casing which may be internally reinforced by a double T-girder. The flap body 111 is connected to the U-shaped profile member 28 by screws 114 through the angular members 113 and by bolts 115 passing through the flap body. The lower sides of the U-shaped profile members 28 are connected to the next section of the star beam by flaps 116 and screw bolts 122.

At a distance from the upper ring 101 which serves as a framework, a lower ring 117 may be provided, the rings 101 and 117 being held in spaced relationship by means of posts 118. The freely projecting star beams 27 may be held under tension by ropes 119, 120, 121. As the diameter of the building decreases, thus making part of the star beam unnecessary because it is no longer supported by the yoke structure, the corresponding outer star beam portion is removed to reduce the weight to be carried. The removal of the corresponding sections *27c* or *27b* at the joint area is carried out by removing the screws 114, 115, 122 connected to the section after which the U-shaped profile members 28 are consecutively removed. Also, the flap body 111 can be completely removed from the joint area.

With the further reduction of the diameter of the building, the central star beam portion *27b* may also be removed at the joint area between sections *27a* and *27b*. This offers the advantage that the star beams will not project with the reduced diameter.

While a specific embodiment of the invention has been described, the invention should not be limited thereto for obvious modifications will occur to those skilled in the art without departing from the spirit and scope of the invention.

I claim:

1. Apparatus for successively lifting sliding molds during constructuion of the wall of a concrete building or the like wherein said wall may be straight or curved and may have a variable cross-section, said apparatus comprising:

(a) a plurality of hoist means;

(b) a plurality of yoke structures, each of said yoke structures comprising a lower, substantially horizontal traverse secured to one of said hoist means, an upper substantially horizontal traverse along said hoist means, spaced substantially parallel inner and outer yoke posts extending between said lower and upper traverses whereby said lower and upper traverses and inner and outer yoke posts together form a parallelogram configuration, said yoke posts extending below said lower traverse, means pivotally connecting said inner and outer yoke posts to said lower and upper traverses at the corners of said parallelogram, and means adjustable in length and pivotally connected at one end to one of said inner and outer yoke posts and at the opposite end to one of said lower and upper traverses at points on said one yoke post and one traverse spaced from the pivot means connecting said one yoke post to said one traverse for changing the angular relationship of said yoke posts and traverses forming said parallelogram configuration;

(c) a plurality of star beams arranged in a radial configuration above said plurality of yoke structures;

(d) means displaceably securing each of said yoke structures to one of said star beams and adjustment means to move each of said yoke structures radially along the respective star beam;

(e) an inner sliding mold of annular configuration connected to and supported by the plurality of said inner yoke posts; and (f) an outer sliding mold of annular configuration spaced from and surrounding said inner annular sliding mold and connected to and supported by the plurality of said outer yoke posts;

(g) whereby the inclination of said inner and outer yoke posts and said inner and outer sliding molds may be adjusted by adjustment of the length of said braces, said yoke structures and inner and outer sliding molds may be moved upwardly by said hoists, and said yoke structures and inner and outer sliding molds may be moved radially by said moving means.

2. Apparatus according to claim 1 wherein said means displaceably securing each said yoke structure to said star beam comprises a plurality of guides on said yoke structure slidable on said star beam.

3. Apparatus according to claim 1 further comprising means for adjusting the position of said pivotal connecting means of said inner yoke post along the length of each of said traverses of each of said yoke structures.

4. Apparatus according to claim 3 wherein each of said adjustment means to move each of said yoke structures radially along the respective star beam and said means for adjusting the position of said pivotal connecting means of said inner yoke post along the length of each of said traverses comprise hydraulic means, said apparatus further comprising a central hydraulic control and hydraulic tubular means extending between said central hydraulic control and each of said hydraulic adjustment means.

5. Apparatus according to claim 1 further comprising means for adjusting the distance between said inner and outer yoke posts along the length of said respective traverses of each of said yoke structures.

6. Apparatus according to claim 1 wherein said means adjustable in length for changing the angular relationship of said yoke posts is a turnbuckle brace.

7. Apparatus according to claim 1 wherein said means pivotally connecting said inner yoke posts to said respective traverses comprise bolts having flat semicircular ends.

8. Apparatus according to claim 1 further comprising a hydraulically operable threaded spindle and nut arrangement on each of said traverses for adjusting the position of said inner yoke post on the respective traverse of each yoke structure, hydraulic means for driving one of said threaded spindles of said yoke structure and a telescopic brace having universal joints at opposite ends thereof operatively connected between said hydraulic drive means on said one traverse and said threaded spindle on the other traverse for synchronously driving both said threaded spindles.

9. Apparatus according to claim 1 wherein said sliding molds comprise mold skins and means for adjustably connecting said mold skins to said yoke posts.

10. Apparatus according to claim 9 wherein each of said mold skins comprises main plates, shifing plates therebetween and at least one additional plate between said shifting plates and means for adjusting and securing said plates relative to each other.

11. Apparatus according to claim 1 further comprising upper working platforms pivotally connected to said yoke posts.

12. Apparatus according to claim 11 further comprising lower working platforms supported by inner holding bars inserted into said yoke posts and outer holding bars pivotally connected to said upper working platforms whereby said lower working platforms may be pivoted to a horizontal position.

13. Apparatus according to claim 1 wherein each of said star beams comprises a plurality of sections and means releasably securing said sections in end-to-end relationship.

* * * * *